US009290926B2

(12) United States Patent
Sidhu

(10) Patent No.: US 9,290,926 B2
(45) Date of Patent: Mar. 22, 2016

(54) CROSS BRACED JOIST HANGER

(71) Applicant: INT'L JOIST ARMOR SYSTEMS INC., Kelowna (CA)

(72) Inventor: Geoffrey Rajay Sidhu, Kelowna (CA)

( * ) Notice: Subject to any disclaimer, the term of this patent is extended or adjusted under 35 U.S.C. 154(b) by 0 days.

(21) Appl. No.: 13/872,929

(22) Filed: Apr. 29, 2013

(65) Prior Publication Data

US 2014/0318073 A1 Oct. 30, 2014

(51) Int. Cl.

| | |
|---|---|
| ***E04C 3/02*** | (2006.01) |
| ***E04B 1/26*** | (2006.01) |
| ***E04B 5/12*** | (2006.01) |

(52) U.S. Cl.

CPC ..... *E04B 1/2612* (2013.01); *E04B 5/12* (2013.01); *E04C 2003/026* (2013.01)

(58) Field of Classification Search

CPC ... E04C 2003/026; E04C 3/02; E04B 1/2612; E04B 5/12

USPC ..... 52/289, 702, 712, 657, 695, 696, 715; 403/232.1, 237

See application file for complete search history.

(56) References Cited

U.S. PATENT DOCUMENTS

| | | | | |
|---|---|---|---|---|
| 457,664 | A | | 8/1891 | Paine |
| 1,106,845 | A | | 7/1913 | Ream |
| 1,145,385 | A | | 7/1915 | Marble |
| 1,558,239 | A | | 10/1925 | Costello |
| 1,574,329 | A | | 2/1926 | White |
| 1,642,945 | A | | 10/1926 | Davidson |
| 1,649,226 | A | | 11/1927 | Gstalder |
| 1,657,243 | A | | 1/1928 | Daniels |
| 1,780,579 | A | | 4/1928 | Crowley |
| 1,656,741 | A | | 8/1928 | Lane |
| 1,729,741 | A | | 10/1929 | Heltzel |
| 1,822,332 | A | | 9/1930 | Bates, Jr. |
| 1,867,449 | A | | 7/1932 | Eckert |
| 1,934,708 | A | | 11/1933 | Hatch |
| 2,110,863 | A | | 3/1938 | Barnett |
| 2,191,979 | A | | 2/1940 | Bierbach |
| 2,204,566 | A | * | 6/1940 | Buelow ..... 52/695 |
| 2,369,525 | A | | 2/1945 | Blaski |
| 2,856,646 | A | | 2/1957 | Latimer et al. |
| 2,865,059 | A | | 12/1958 | Scriven |
| 2,911,690 | A | | 11/1959 | Sanford |
| 2,964,807 | A | | 12/1960 | Kennedy |

(Continued)

FOREIGN PATENT DOCUMENTS

| | | |
|---|---|---|
| CA | 2730837 | 8/2011 |
| FR | 2602533 | 2/1988 |

(Continued)

*Primary Examiner* — Brian Glessner
*Assistant Examiner* — Gisele Ford
(74) *Attorney, Agent, or Firm* — Richard D. Okimaw

(57) ABSTRACT

An apparatus for supporting adjacent parallel spaced apart joists from a perpendicular beam. Each of the joists extends between first and second ends and has top and bottom edges. The apparatus comprises an elongate member sized to extend between a first end proximate to a top edge of a first joist and a second end proximate to a bottom edge of an adjacent joist. The apparatus further comprises a joist support platform extending from the second end of the elongate member adapted to receive a bottom edge of a first joist thereon, at least one bottom beam engaging panel extending from the joist support platform and a joist cap extending from the first end of the elongate member adapted to overly a top edge of a second joist adjacent to the first joist.

14 Claims, 13 Drawing Sheets

(56) References Cited

U.S. PATENT DOCUMENTS

| | | | | |
|---|---|---|---|---|
| 3,049,764 | A | | 8/1962 | Kawalle |
| 3,184,800 | A | | 5/1965 | Nelson |
| 3,422,585 | A | | 1/1969 | Dismukes |
| 3,423,898 | A | | 1/1969 | Tracy et al. |
| 3,596,941 | A | | 8/1971 | Tracy |
| 3,708,942 | A | | 1/1973 | Leonard |
| 3,727,358 | A | | 4/1973 | Howell |
| 3,959,945 | A | | 6/1976 | Allen |
| 4,007,570 | A | | 2/1977 | Hunter |
| 4,040,232 | A | | 8/1977 | Snow et al. |
| 4,077,176 | A | | 3/1978 | Bauer |
| 4,143,500 | A | | 3/1979 | Sanford |
| 4,160,350 | A | | 7/1979 | Craib |
| 4,189,247 | A | | 2/1980 | Burwall |
| 4,192,118 | A | | 3/1980 | Gilb |
| 4,192,406 | A | | 3/1980 | Mitchell |
| 4,200,406 | A | | 4/1980 | Fuss |
| 4,230,416 | A | | 10/1980 | Gilb |
| 4,246,736 | A | | 1/1981 | Kovar et al. |
| 4,332,501 | A | | 6/1982 | Slysh |
| 4,382,710 | A | | 5/1983 | Slowbe |
| 4,414,785 | A | | 11/1983 | Howell |
| 4,455,805 | A | | 6/1984 | Rionda et al. |
| 4,498,801 | A | | 2/1985 | Gilb |
| 4,561,230 | A | | 12/1985 | Rionda et al. |
| 4,604,845 | A | | 8/1986 | Brinker |
| 4,637,195 | A | | 1/1987 | Davis |
| 4,669,235 | A | | 6/1987 | Reinen |
| 4,770,274 | A | | 9/1988 | Middleton |
| 4,843,726 | A | | 7/1989 | Ward |
| 4,910,934 | A | | 3/1990 | Hennings |
| RE34,022 | E | | 8/1992 | Davis |
| 5,197,818 | A | | 3/1993 | Johnson |
| 5,307,603 | A | | 5/1994 | Chiodo |
| 5,335,470 | A | | 8/1994 | Alvarez |
| 5,375,384 | A | | 12/1994 | Wolfson |
| 5,412,920 | A | | 5/1995 | Hess |
| 5,448,871 | A | | 9/1995 | Newman et al. |
| 5,467,570 | A | | 11/1995 | Leek |
| 5,603,580 | A | | 2/1997 | Leek et al. |
| 5,606,837 | A | | 3/1997 | Holizlander |
| 5,653,079 | A | | 8/1997 | Loeffler et al. |
| 5,697,725 | A | | 12/1997 | Ballash et al. |
| 5,732,524 | A | | 3/1998 | Kalker |
| 5,836,131 | A | | 11/1998 | Viola et al. |
| 5,867,962 | A | | 2/1999 | Scott et al. |
| 5,899,042 | A | | 5/1999 | Pellock |
| 5,937,608 | A | * | 8/1999 | Kucirka ..... 52/695 |
| 5,996,303 | A | | 12/1999 | Pellock |
| 6,003,280 | A | | 12/1999 | Wells |
| 6,170,218 | B1 | | 1/2001 | Shahnazarian |
| 6,260,318 | B1 | | 7/2001 | Herren |
| 6,354,055 | B1 | | 3/2002 | Shaw et al. |
| 6,393,794 | B1 | | 5/2002 | Pellock |
| 6,418,695 | B1 | | 7/2002 | Daudet et al. |
| 6,758,022 | B1 | | 7/2004 | Coll et al. |
| 6,837,019 | B2 | | 1/2005 | Collie |
| 6,993,882 | B2 | | 2/2006 | Crawford et al. |
| 7,090,174 | B2 | | 8/2006 | Korczak et al. |
| 7,454,872 | B2 | | 11/2008 | Cutforth |
| D607,711 | S | | 1/2010 | Adams et al. |
| 7,885,867 | B2 | | 2/2011 | Krystek et al. |
| 8,302,360 | B2 | | 11/2012 | Legnini |
| 8,756,895 | B1 | * | 6/2014 | Sidhu et al. ..... 52/696 |
| 2005/0224667 | A1 | | 10/2005 | Whale et al. |
| 2007/0022701 | A1 | | 2/2007 | Surowiecki |
| 2007/0044417 | A1 | | 3/2007 | Surowiecki |
| 2009/0151294 | A1 | | 6/2009 | Staley |
| 2009/0217603 | A1 | | 9/2009 | Brady |
| 2011/0154770 | A1 | | 6/2011 | Friis |
| 2012/0203367 | A1 | | 8/2012 | Burda et al. |
| 2012/0272608 | A1 | * | 11/2012 | Groenesteyn ..... 52/657 |
| 2014/0311082 | A1 | | 10/2014 | Sidhu |

FOREIGN PATENT DOCUMENTS

| | | | |
|---|---|---|---|
| GB | 425624 | | 3/1935 |
| GB | 2436334 | | 9/2007 |
| GB | 2451686 | | 2/2009 |
| WO | 2005007983 | | 1/2005 |
| WO | 2008/141117 | A1 | 11/2008 |
| WO | WO 2009/094303 | A2 | 7/2009 |
| WO | 2011057377 | | 5/2011 |
| WO | 2013102257 | | 7/2013 |

* cited by examiner

CROSS BRACED JOIST HANGER

BACKGROUND OF THE INVENTION

1. Field of Invention

The present invention relates generally to construction in general and in particular a method and apparatus for cross-bracing adjacent joists members together.

2. Description of Related Art

Many forms of building construction utilize joists to form a portion or all of a floor, ceiling or other horizontal partition within the building. Such joists are commonly a plurality of substantially horizontal parallel spaced apart members. A common method of forming a floor or the like with such joists is to support the joists from a beam, header board or ledger board located at each end of the joist such that the beams and joists form a common top or bottom surface.

One common method of securing joists to beams, header or ledger boards by means of joist hangers. Joist hangers conventionally comprise a strip of material located under an end of the joist with side portions extending along the sides thereof which are secured to the beam or header. Nails or other suitable fasteners may then be passed through holes within the joist hanger to secure the joist and beam thereto.

As conventionally known, each joist hanger supports an end of a single joist at a single location along the beam. Accordingly, each joist may be permitted to move independently of each other thereby compromising the overall strength and stability of the floor. Additionally, it is known that were joists are permitted to move independently of each other, such floors may be more prone to transmitting vibration and developing squeaks. It will also be observed that conventional joist hangers are typically designed to provide a substantially vertical support force to the joists and will provide little resistance to torques and rotations of the joists.

SUMMARY OF THE INVENTION

According to a first embodiment of the present invention, there is disclosed an apparatus for supporting adjacent parallel spaced apart joists from a perpendicular beam. Each of the joists extends between first and second ends and has top and bottom edges. The apparatus comprises an elongate member sized to extend between a first end proximate to a top edge of a first joist and a second end proximate to a bottom edge of an adjacent joist. The apparatus further comprises a joist support platform extending from the second end of the elongate member adapted to receive a bottom edge of a first joist thereon, at least one bottom beam engaging panel extending from the joist support platform and a joist cap extending from the first end of the elongate member adapted to overly a top edge of a second joist adjacent to the first joist.

The joist support platform may include side walls extending therefrom to contain the joist therebetween. The at least one bottom beam engaging panel may comprise a pair of bottom fastening strips extending substantially upwards from the joist support platform along the beam. The bottom fastening strips may extend over a top edge of the beam. The bottom fastening strips may be located adjacent to the joist. The bottom fastening strips may include a plurality of fastener bores.

The joist cap may extend to the beam. The apparatus may further comprise at least one top beam engaging panel extending from the joist cap. The at least one top beam engaging panel may comprise an end portion of the joist cap. The at least one top beam engaging panel may extend over a top of the beam. The at least one top beam engaging panel may comprise a pair of top fastening strips extending substantially downwards from the joist cap. The top fastening strips may be located adjacent to the joist. The top fastening strips may include a plurality of fastener bores.

According to a first embodiment of the present invention, there is disclosed a system for supporting adjacent parallel spaced apart joists from a perpendicular beam. Each of the joists extends between first and second ends and has top and bottom edges. The system comprises at least one beam engaging member, each beam engaging member comprises an elongate member sized to extend between a first end proximate to a top edge of a first joist and a second end proximate to a bottom edge of an second adjacent joist. Each beam engaging member further comprising a joist support platform extending from the second end of the elongate member adapted to receive a bottom edge of a first joist thereon, at least one bottom beam engaging panel extending from the joist support platform and a joist cap extending from the first end of the elongate member adapted to overly a top edge of a second joist adjacent to the first joist. The system further comprises at least one cross brace member comprising an elongate member sized to extend between a first end proximate to a top edge of the second joist and a second end proximate to a bottom edge of the adjacent first joist. Each cross brace member further comprises a joist support platform extending from the second end of the elongate member and a joist cap extending from the first end of the elongate member.

The joist support platform of the at least one cross brace member is engageable with the joist support platform of the beam engaging member. The joist cap of the at least one cross brace member is engageable with the joist cap of the beam engaging member.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
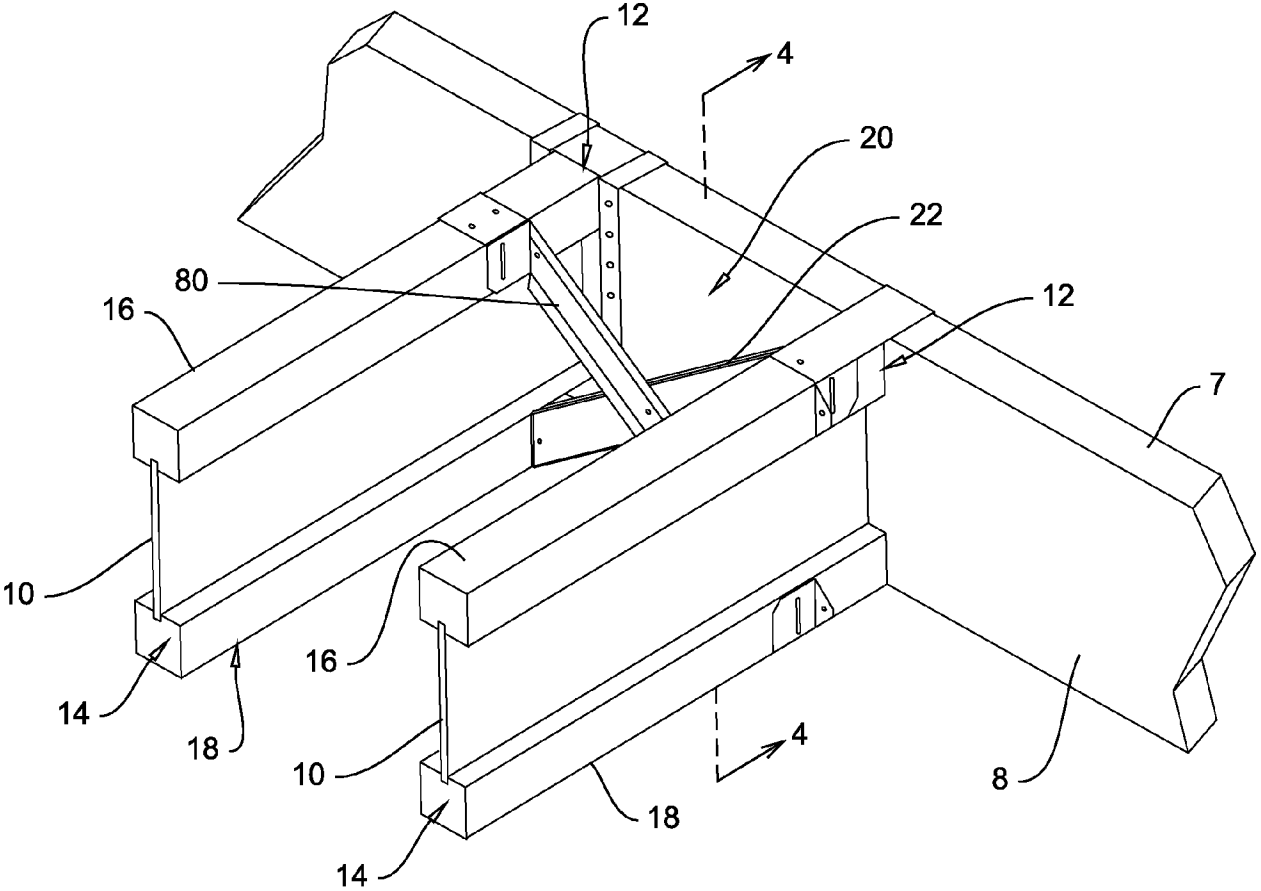
FIG. 1 is a perspective view of a system for supporting adjacent joists according to a first embodiment of the present invention.

Referring to FIG. 1, a system for supporting adjacent joists 10 from an end beam or member 8 according to a first embodiment of the invention is shown generally at 20. Each joist 10 comprises an elongate member extending between first and second ends, 12 and 14, respectively having top and bottom edges 16 and 18, respectively. It will be appreciated that although the present system is described for use with a joist, other structural members, such as, by way of non-limiting example, beams, trusses or the like may also be supported in a similar manner as described herein. As described herein, the joist 10 may comprise a floor or ceiling joist, such as by way of non-limiting example dimensioned lumber, space frame or I-joists formed of wood, composite materials, metal or the like.

As illustrated in FIG. 1, the system 20 comprises at least one beam engaging member 22 and at least one cross brace member 80. The beam engaging member 22 is adapted to engage with the beam 8 so as to suspend the joists 10 therefrom. As illustrated each beam engaging member 22 engages a top edge 16 of one joist and a bottom edge 18 of an adjacent joist as well as the portion of the beam 8 corresponding to each of the first and second joists as will be more fully described below. Similarly, each cross brace member engages a bottom edge of the first joist as well as the top edge 16 of the adjacent joist and may be further connected to adjacent beam engaging members as will be more fully described below. In such a manner it will be appreciated that any load applied to one joist will be distributed to the adjacent joists and locations along the beam so as to more evenly distribute such loads along the floor structure. It will also be appreciated that vibrations and movements applied to one joist will be similarly distributed across the entire floor.

Figure 2:
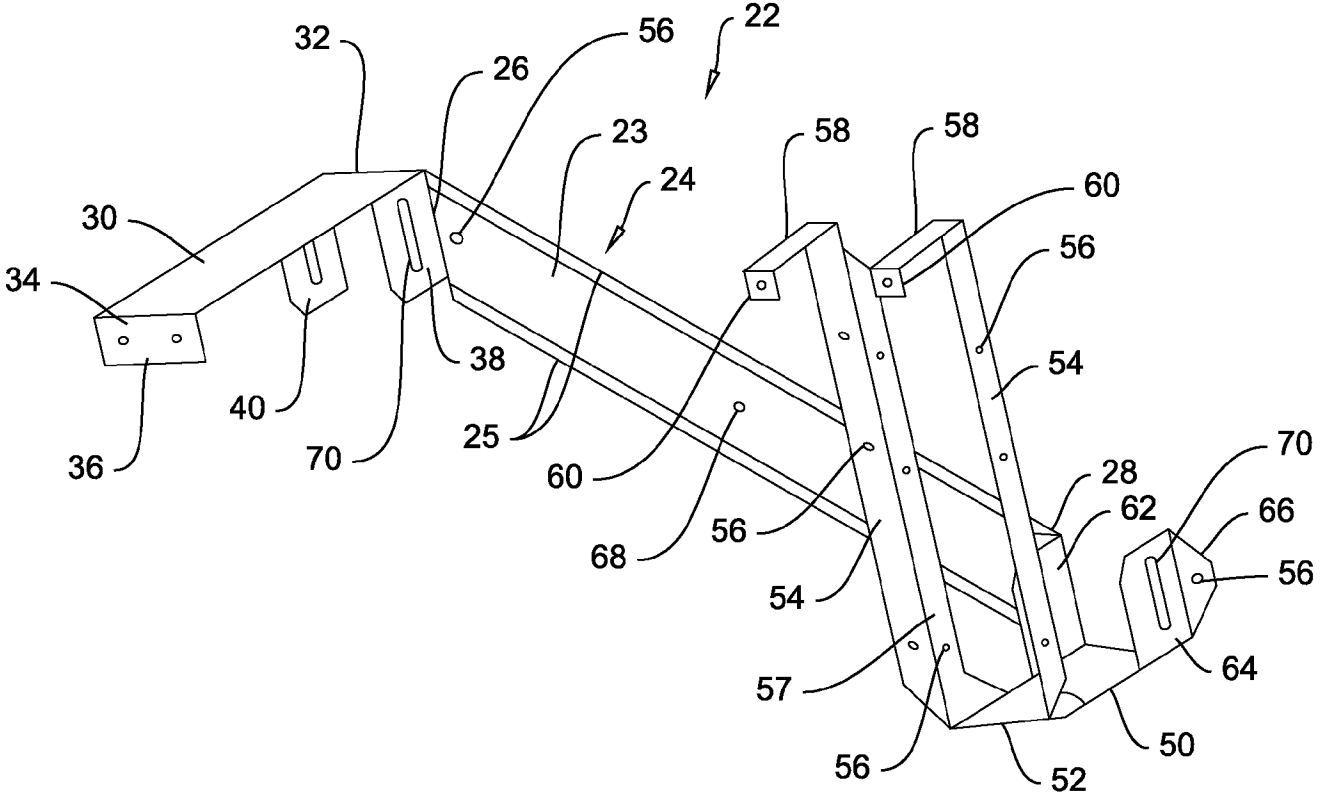
FIG. 2 is a perspective view of an apparatus for supporting adjacent joists for use in the system of FIG. 1.

With reference to FIG. 2, each beam engaging member comprises a rigid member 24 extending between first and second ends, 26 and 28, respectively. The first end 26 of the first rigid member 24 includes a joist cap 30 extending therefrom adapted to overly a top edge 7 of the beam 8. The joist cap 30 extends between proximate and distal ends, 32 and 34, respectively wherein the proximate end 32 is proximate to the first rigid member 24. Optionally, the distal end 34 may include a lip or end wall 36 adapted to be located on a side of the beam opposite from the joists 10 so as to locate the beam 8 between the end wall 36 and the first rigid member 24. The second end 28 of the first rigid member 24 includes a joist support platform 50 extending therefrom adapted to receive a joist 10 thereon.

The joist support platform 50 extends to the beam at a distal end 52 thereof and includes at least one bottom beam engaging strip 54 extending substantially upwardly therefrom. The bottom beam engaging strips 54 are adapted to lie against the beam 8 and include fastener bores 56 extending therethrough for passing fasteners (not shown) to secure the bottom beam engaging strips to the beam. As illustrated, the bottom beam engaging strips 54 may optionally include top planar portions 58 extending therefrom located to extend over a top edge of the beam and may further optionally include end walls 60 located at distal ends of the top planar portions 58 so as to engage upon a rear surface of the beam to receive the beam between the end walls 60 and the bottom beam engaging members 54. Optionally the bottom beam engaging strips 54 may also include a perpendicular joist engaging portion 57 extending therealong having fastener bores 56 for securing to the joist 10.

The joist cap 30 and joist support platform 50 may be selected to have a length sufficient to locate the first rigid member 24 at any distance from the beam as desired by a user, such as, by way of non-limiting example, to provide a distance of between 1 and 12 inches (25 and 306 mm) therebetween.

As illustrated in FIG. 2, the joist cap 30 may include first and second side walls, 38 and 40, respectively extending therefrom positioned to lie adjacent to opposed sides of the joist so as to retain the joist 10 therebetween. Similarly, the joist support platform 50 may also include first and second side walls, 62 and 64, respectively extending therefrom positioned to lie adjacent to opposed sides of the joist so as to retain the joist 10 therebetween. Optionally, the second side walls 40 and 64 of the joist cap 30 and joist support platform 50 may include a tab 66 having fastener bores 56 extending therefrom so as to permit connection to an adjacent cross brace member as further described below. The side walls 38, 40, 62 and 64 may have a height selected to provide sufficient engagement upon the joist or may be selected to correspond to the flange thickness of an engineered or I-Beam joist, such as, by way of non-limiting example, between 1 and 3 inches (25 and 76 mm).

It will be appreciated that dimensioned lumber is commonly of a 1.5 inch width and therefore for applications using such dimensional lumber for floor joists the side walls 38 and 40 and 62 and 64 will be spaced apart by a similar width. It will be appreciated that other thicknesses of structural members in general and joists in particular may also be utilized, such as, by way of non-limiting example, sized to accommodate a doubled up floor joist, a 2½ inch wide floor joist or other common wood, composite material or metal floor joist sizes. In some applications, the side walls may be spaced apart slightly larger than the width of the joist so as to facilitate installation such as, by way of non-limiting example, up to 3.2 mm (⅛ of an inch) larger than the joist for which they are designed.

The first and second side walls 38 and 40 of the joist cap and first and second side walls 62 and 64 of the joist support platform may include one or more apertures 70 therethrough to permit nails, screws or other suitable fasteners to be passed therethrough so as to secure the sockets to the joist 10 therein. As illustrated in FIG. 2, the apertures 70 may comprise circular bores, a plurality of bores, slots or any other suitable opening. Optionally, the side walls 38, 40, 62 and 64 may include barbs, spikes or other suitable projections from an interior surface thereof so as to engage the joist when the system 20 is secured thereto. Adhesives may also be applied between the top and bottom edges 16 and 18 of the joist 10 and apparatus to secure the joist thereto.

Figure 5:
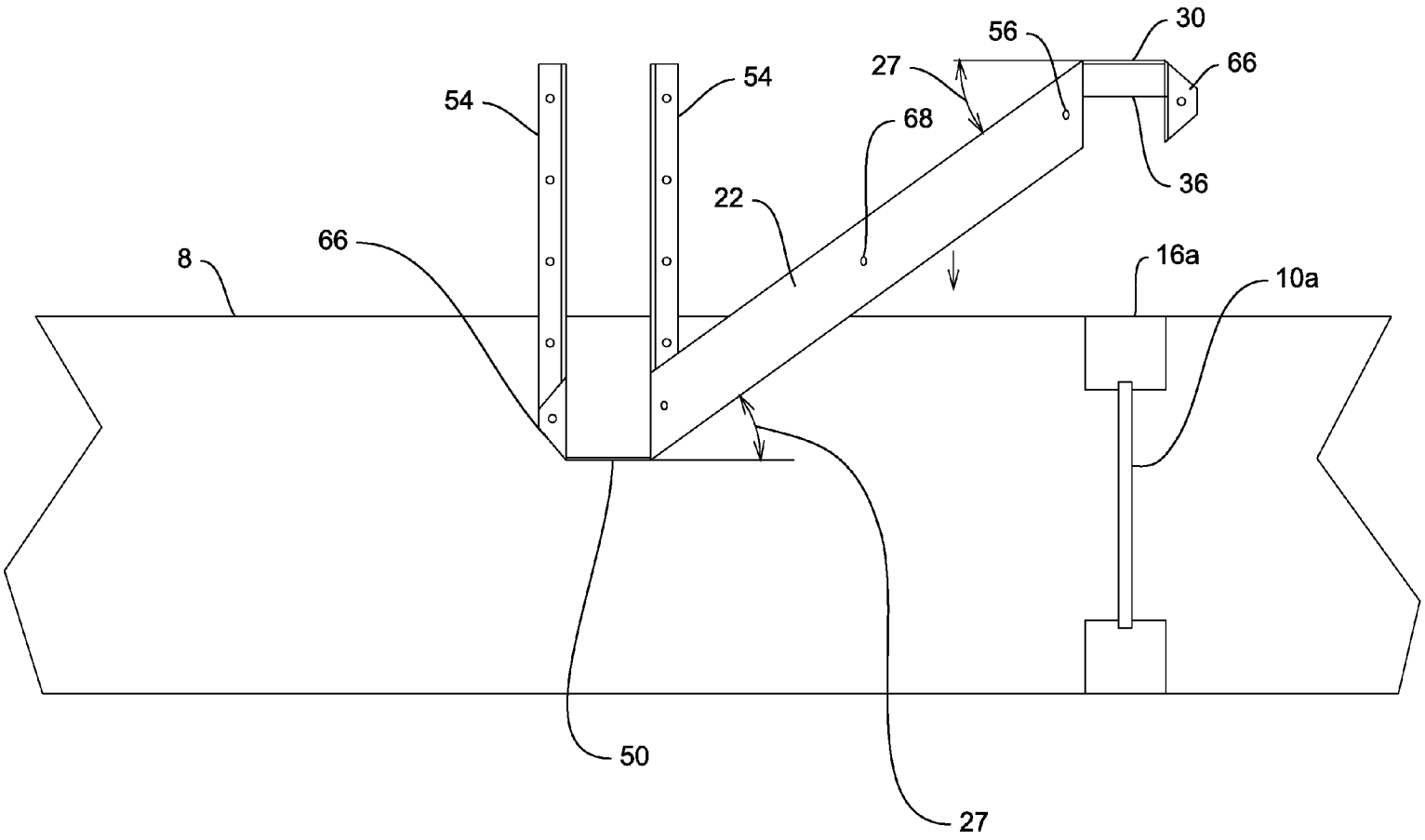
FIG. 5 is a side profile view of the system of FIG. 1 being applied to a first joist extending from a beam at a first step.

The rigid member 24 is sized to extend between a top edge 16 of one joist and a bottom edge 18 of an adjacent joist at an angle 27 as illustrated in FIG. 5. In practice, the length of the rigid member 24 will depend upon both the height of the joists and the spacing distance between them. In particular, the height of the rigid member 24 will correspond to the height of the joists 10. Correspondingly, the distance between the joists 10, which is commonly expressed in centre to centre distance will correspond to the distance to the centres of the side walls 38 and 62.

The first rigid member 24 may be formed of with any suitable shape or profile, such as, by way of non-limiting example, c-shaped, I beam, flat bar, tubular or box frame. In particular, as illustrated, the first rigid member 24 may be formed of sheet metal bent into a c-shaped channel having a web portion 23 and a pair of side walls 25 extending therefrom. The side walls 25 may be bent to the same side of the web portion 23 so as to extend from the same side of the web portion 23 as the joist cap 30 and joist support platform 50. It will also be appreciated that although the first rigid member 24 is illustrated as being formed of bent sheet metal, it may also be formed by other means such as an extruded, cast or welded structure. It will also be appreciated that one or both of the side walls 25 may be omitted depending on the strength requirements of the application. The web portion 23 may include fastener bores 56 the use of which will be more fully described below and a center bore 68 therethrough so as to permit cross brace member 80 to be secured thereto. As illustrated in FIG. 2, the first rigid member 24 may extend from and be connected to the first side walls 38 and 62 of the joist cap 30 and joist support platform 50, however it will be appreciated that for embodiments not includes such side walls, the first rigid member will be secured directly to the joist cap and joist support platforms.

Figure 3:
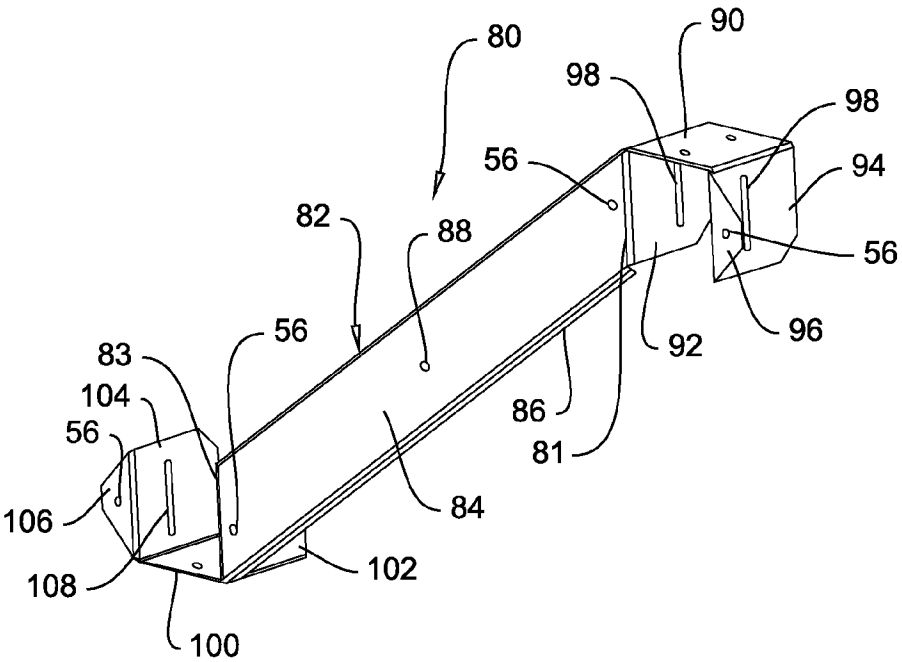
FIG. 3 is a perspective view of a cross-brace for supporting adjacent joists for use in the system of FIG. 1.
Figure 4:
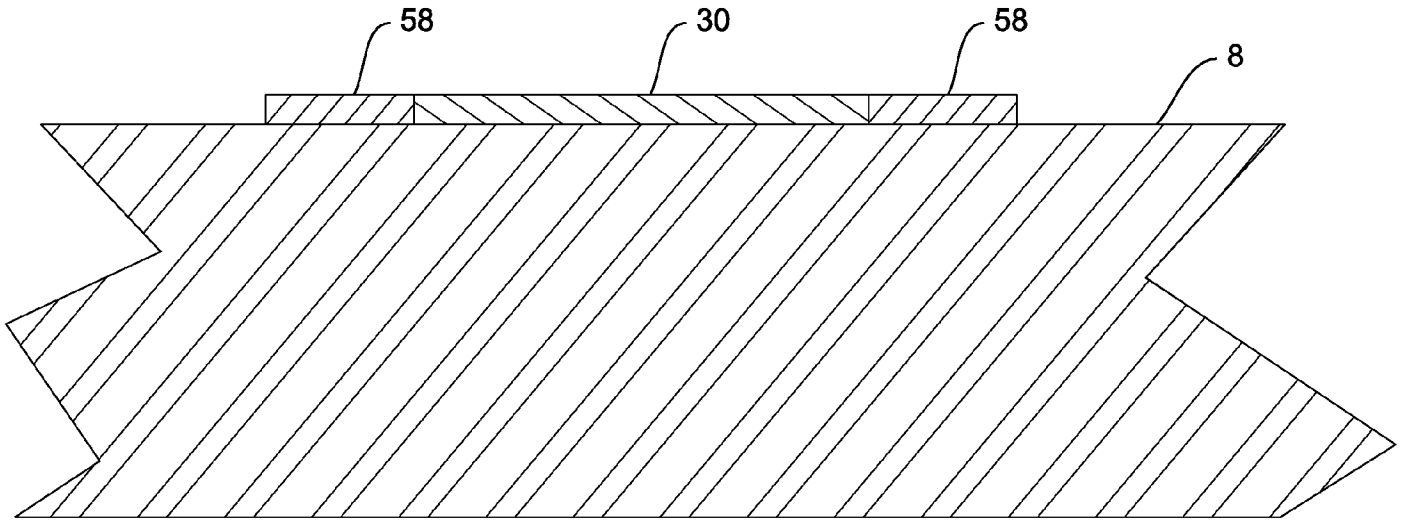
FIG. 4 is a cross-sectional view of the system of FIG. 1 applied to a beam as taken along the line 3-3.

Turning now to FIG. 3, a perspective view of the cross brace member 80 is illustrated. It will be observed that the cross brace member 80 is formed in a substantially similar manner to the beam engaging member 22. In particular, the cross brace member 80 is formed of a second rigid member 82 extending between first and second ends 81 and 83 and may be formed as of a web portion 84 with side walls 86 extending therefrom. The web portion 84 may include a center bore 88 and at least one faster bore 56. At the first end 81 of the second rigid member is a joist cap 90 optionally having first and second side walls, 92 and 94, respectively. At the second end 83 of the second rigid member is a joist support platform 100 optionally having first and second side walls 102 and 104. Optionally the side walls may include mounting tabs 96 and 196 as well as apertures 98 and 108 and fastener bores 56 for passing fasteners through.

In operation, with reference to FIGS. 5 through 8, the system may be applied to a plurality of joists 10 which are to be supported from a beam 8 extending along the first ends 12 of the joists. As illustrated in FIG. 5, a first joist 10*a* may be located at a desired positioned extending from the beam 8 by lowering a beam engaging member 22 downwardly, in a direction generally indicated at 110 such that the joist cap is located on a top edge 16*a* of the first joist 10*a*. Thereafter, fasteners (not shown) may be passed through the fastener bores 56 to secure the bottom beam engaging strips 54 to the beam. Optionally, the first joist may be omitted and the first beam engaging member 22 secured directly to the beam 8 at the desired location.

Figure 6:
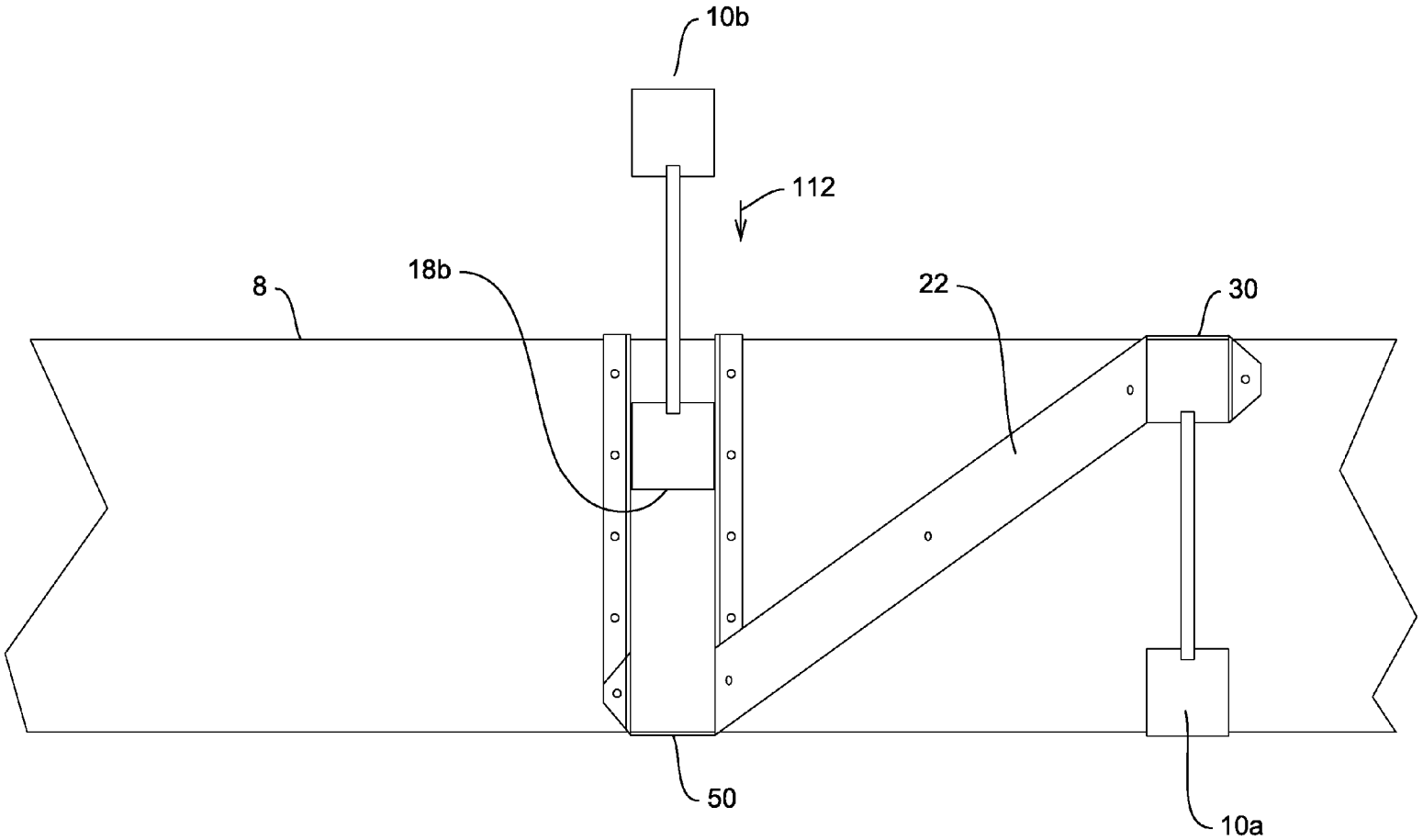
FIG. 6 is a side profile view of the system of FIG. 1 being applied to a first joist extending from a beam at a second step.
Figure 7:
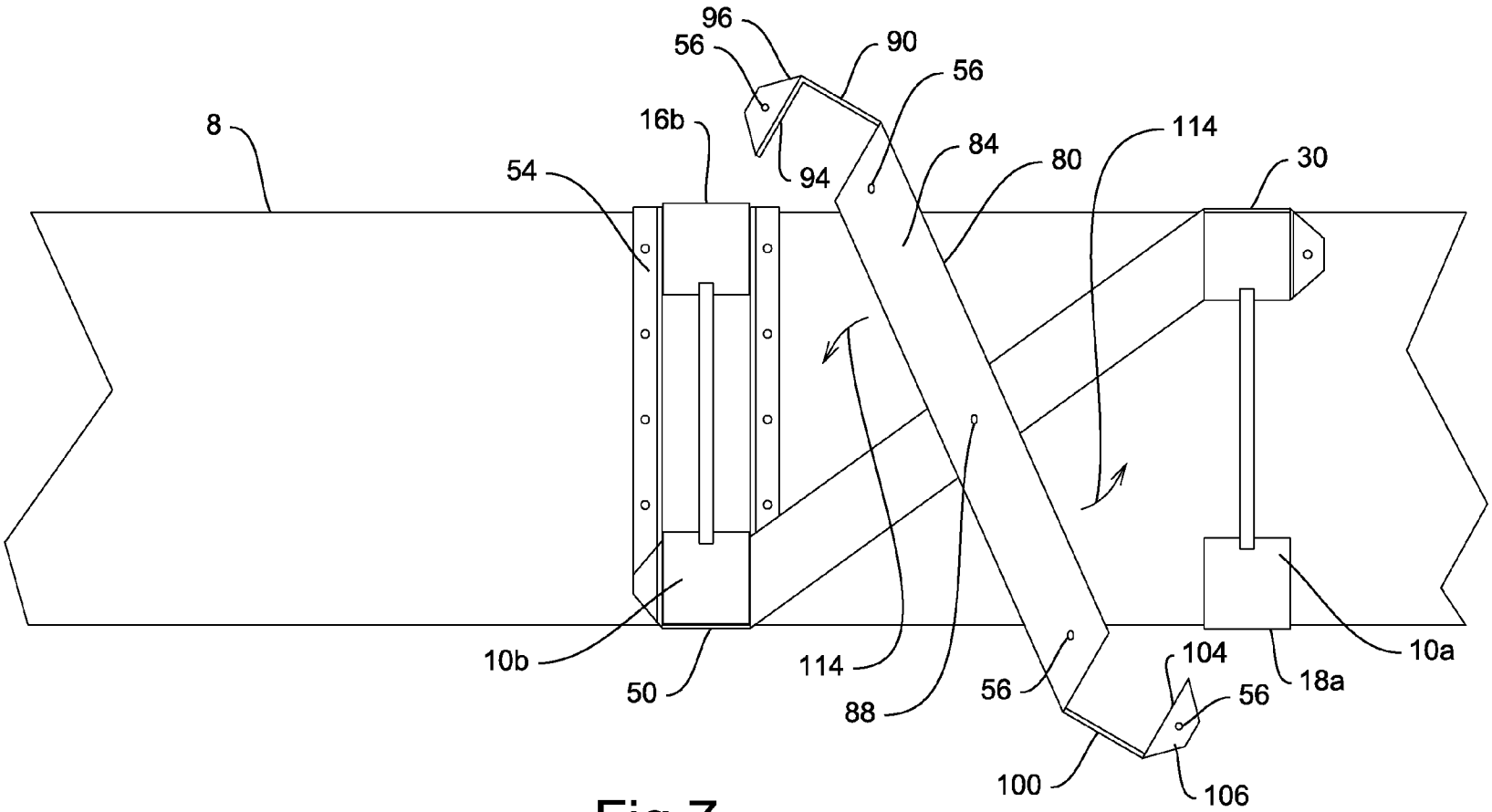
FIG. 7 is a side profile view of the system of FIG. 1 being applied to a first joist extending from a beam at a third step.
Figure 8:
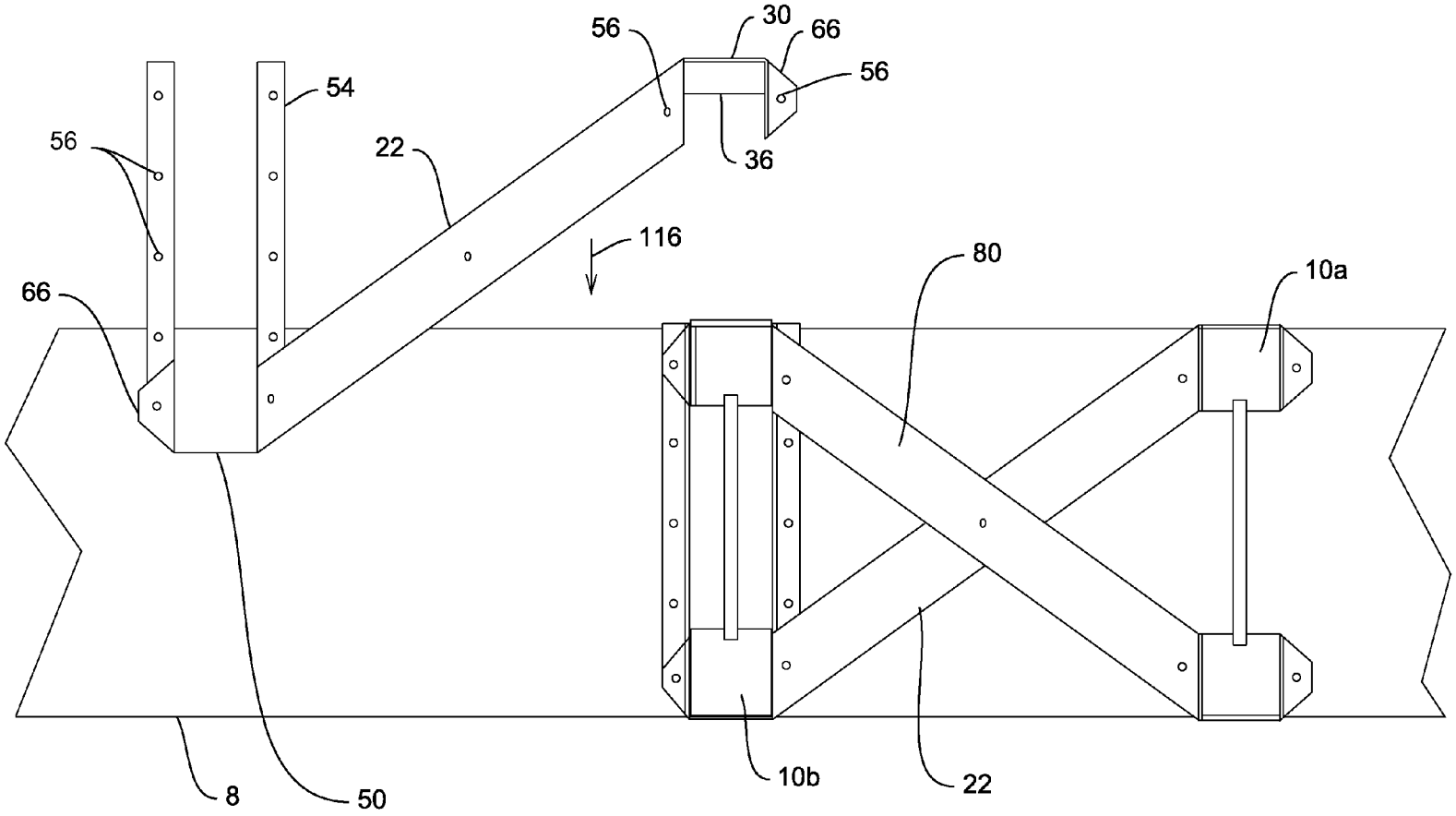
FIG. 8 is a side profile view of the system of FIG. 1 being applied to a first joist extending from a beam at a fourth step.

After securing a beam engaging member 22 to the beam 8, a second joist 10*b* may be lowered, in a direction generally indicated at 1121 into contact with the joist support platform 50 such that the bottom edge 18*b* of the joist 10*b* rest thereon as illustrated in FIG. 6. With reference to FIG. 7, a cross brace member 80 may thereafter be secured on the first and second by locating the cross brace member such that the joist cap 90 is located above the top edge 16*b* of the second member 10*b* and that the joist support platform 100 is located below the bottom edge 18*a* of the first joist 10*a*. Thereafter, the cross brace member 80 may be rotated in a direction generally indicated at 114 to engage the joist cap 90 on the top edge 16*b* and the joist support platform 100 on the bottom edge 18*a*. It will be appreciated that the second side walls 94 and 104 may be bent outwards to facilitate such engagement during rotation. Thereafter, these side walls may be bent back into position to engage their respective edge of the joist.

Figure 9:
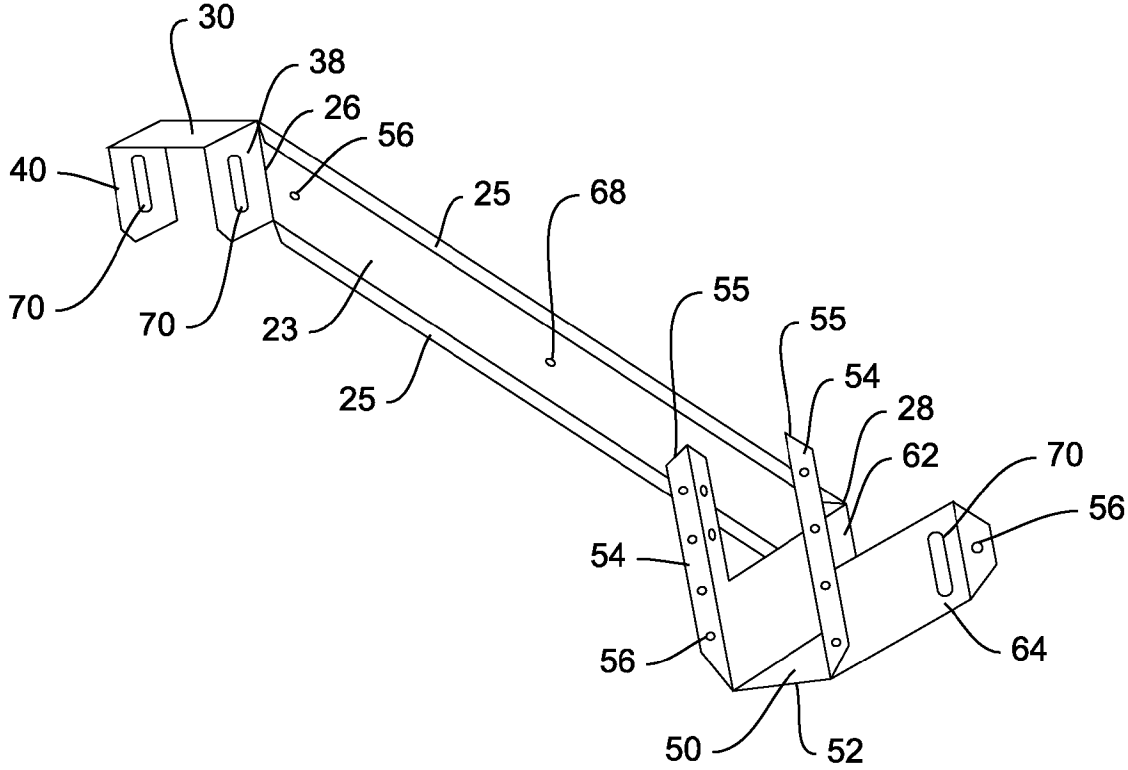
FIG. 9 is a perspective view of an apparatus for supporting adjacent joists for use in the system of FIG. 1 according to a further embodiment of the present invention.
Figure 10:
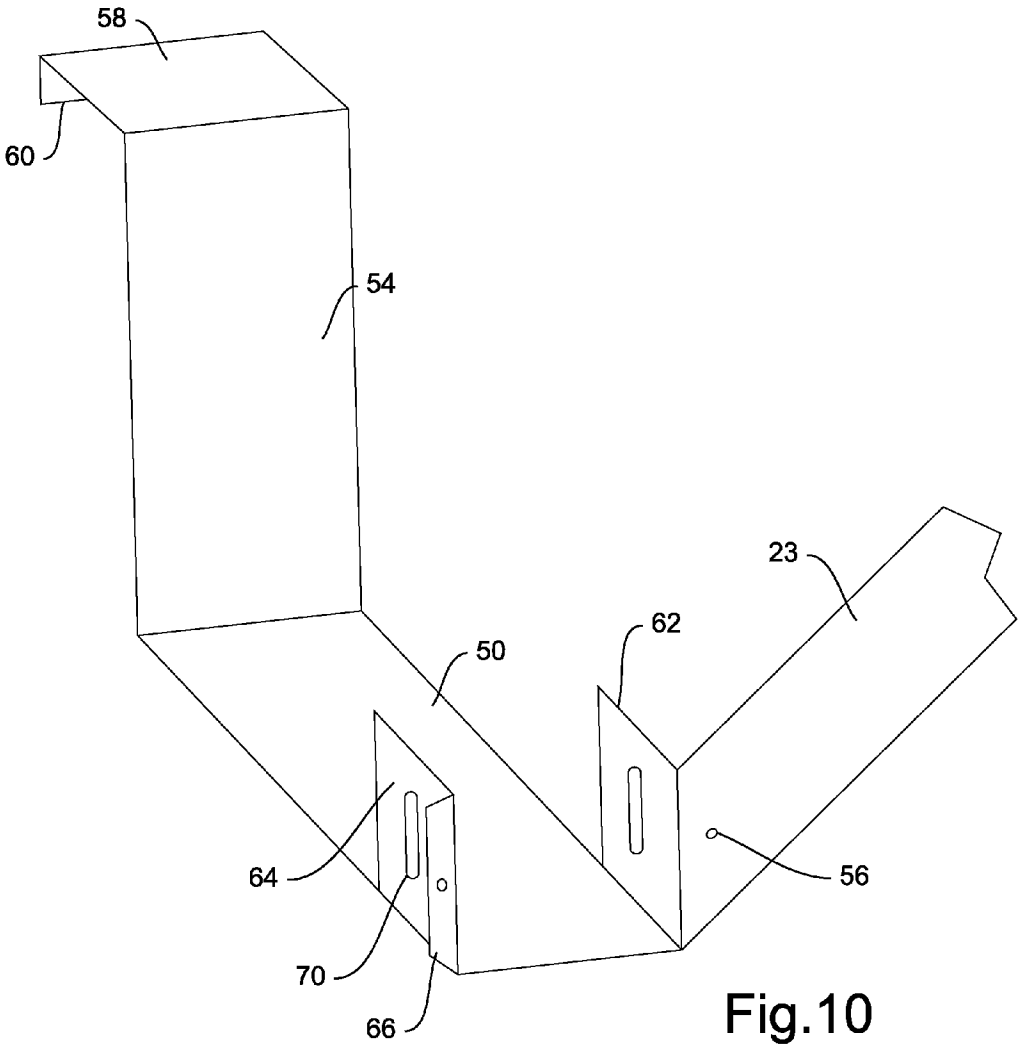
FIG. 10 is a detailed perspective view of the bottom end of an apparatus for supporting adjacent joists for use in the system of FIG. 1 according to a further embodiment of the present invention.
Figure 11:
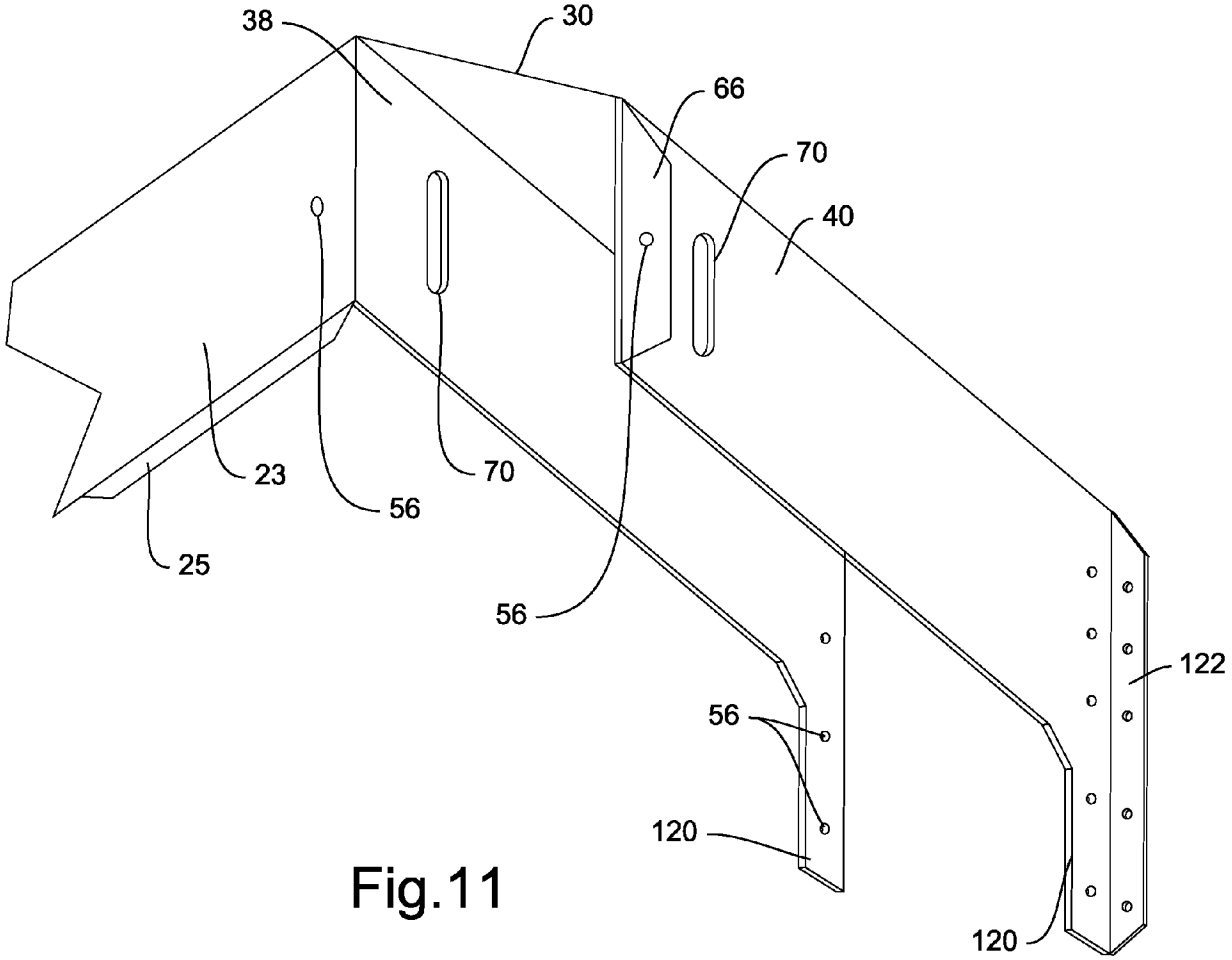
FIG. 11 is a detailed perspective view of the top end of an apparatus for supporting adjacent joists for use in the system of FIG. 1 according to a further embodiment of the present invention.

Turning now to FIG. 9, an alternative embodiment of the beam engaging member 22 is illustrated having a joist cap 30 which does not extend to the end beam 8. In such embodiments, the weight of each joist will be supported by the joist support platform 50 under that joist as well as the adjacent joist support platforms 50 which are interconnected with the joist support platform through the rigid member 24 and the cross brace member 80 connected thereto as set out above. Optionally, as illustrated in FIG. 9, the beam engaging strips 54 may extend only a portion up the height of the beam 8 so as to permit the beam engaging strips 54 to be secured thereto through fasteners passed through the fastener bores 56. The height of the beam engaging strips 54 may be selected to be any height as desired by a user. In particular, it will be appreciated that at heights of up to one half of the height of the beam 8, the beam engaging strips 54 may be abutted against corresponding strips extending from the joist cap as illustrated in FIG. 11 described below. Although the beam engaging strips 54 are illustrated as extending from the joist engaging portions 57 away from the joist support platform 50, it will also be appreciated that they may extend towards each other. Additionally, as illustrated in FIG. 10, a single beam engaging strip 54 may be utilized extending from the joist support platform 50.

With reference to FIG. 11, a joist cap 30 according to a further embodiment is illustrated having first and second side walls 38 and 40 extending to the distal end 34 of the joist cap. The first and second side walls 38 and 40 may include joist engaging extensions 120 with beam engaging strips extending perpendicularly therefrom. The joist engaging extensions 120 and beam engaging strips 122 may extend any length down the beam 8 as selected by a user, such as, by way of non-limiting example, up to one half of the height of the beam 8 so as to permit the beam engaging strips to be located above corresponding beam engaging strips 54 from the joist support platform 50 as set out above. It will be appreciated that each beam engaging member 22 may include any combination of top and bottom joist connections as set out above as desired by a user.

The beam engaging member 22, as well as the cross brace member 80 may be formed of any suitable material, such as, by way of non-limiting example, metal, plastic, composite materials or the like. The beam engaging member 22 and cross brace member 80 may be formed or constructed by any known process, such as, by way of non-limiting example, injection moulding, connecting a plurality of separate panels together by any suitable method, such as, by way of non-limiting example, adhesives, fasteners, welding, braising, or the like. As illustrated herein the beam engaging member 22 and cross brace member 80 may also optionally be formed of a sheet of material, such as, by way of non-limiting example, steel, stainless steel or aluminium and bend or folded in to the desired shape. Any thickness of metal as required to provide the necessary strength may be utilized such as between 12 and 22 gauge. In particular, it has been found that sheet metal of between 16 and 20 gauge has been useful.

Figure 12:
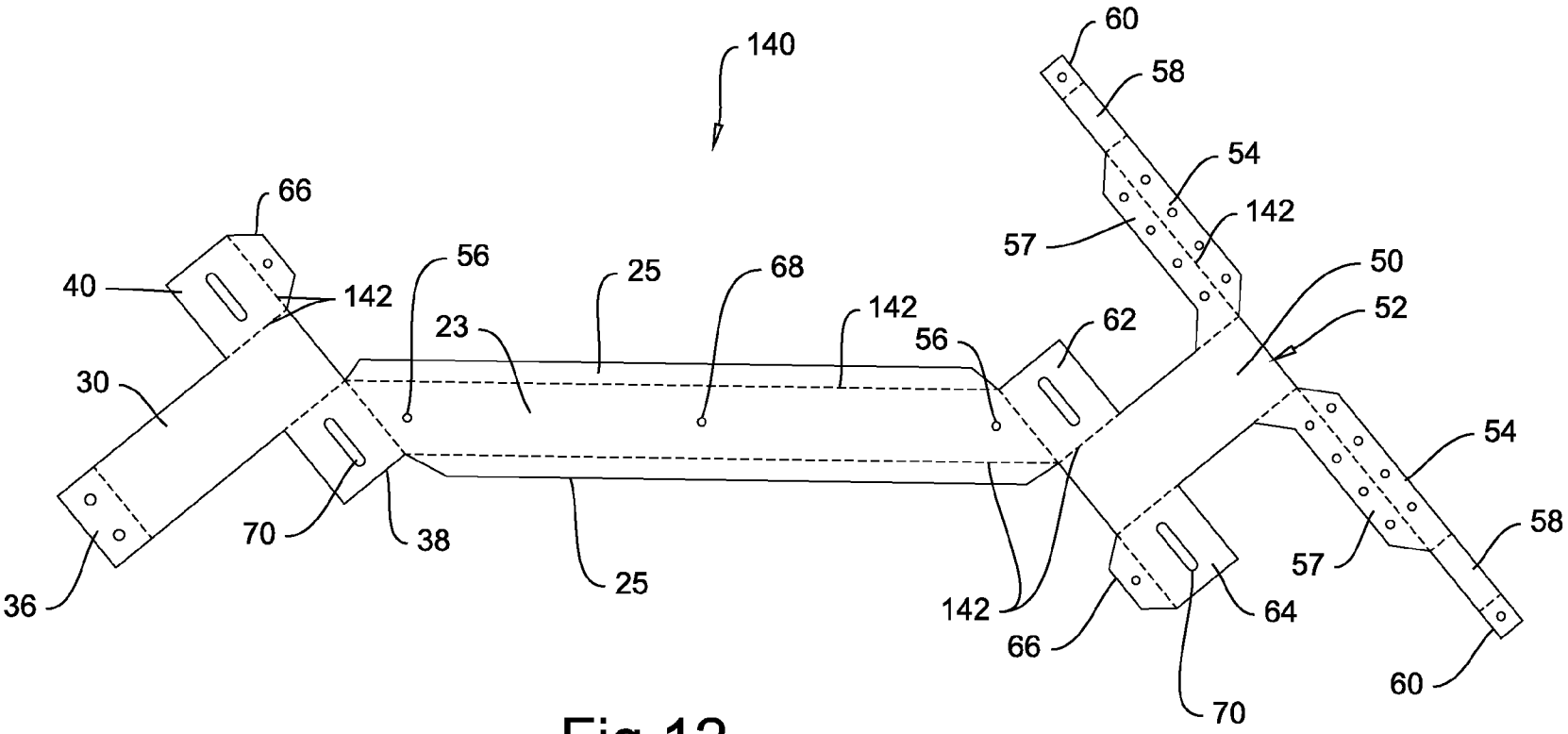
FIG. 12 is a top plan view of a cut sheet for forming the apparatus of FIG. 2.
Figure 13:
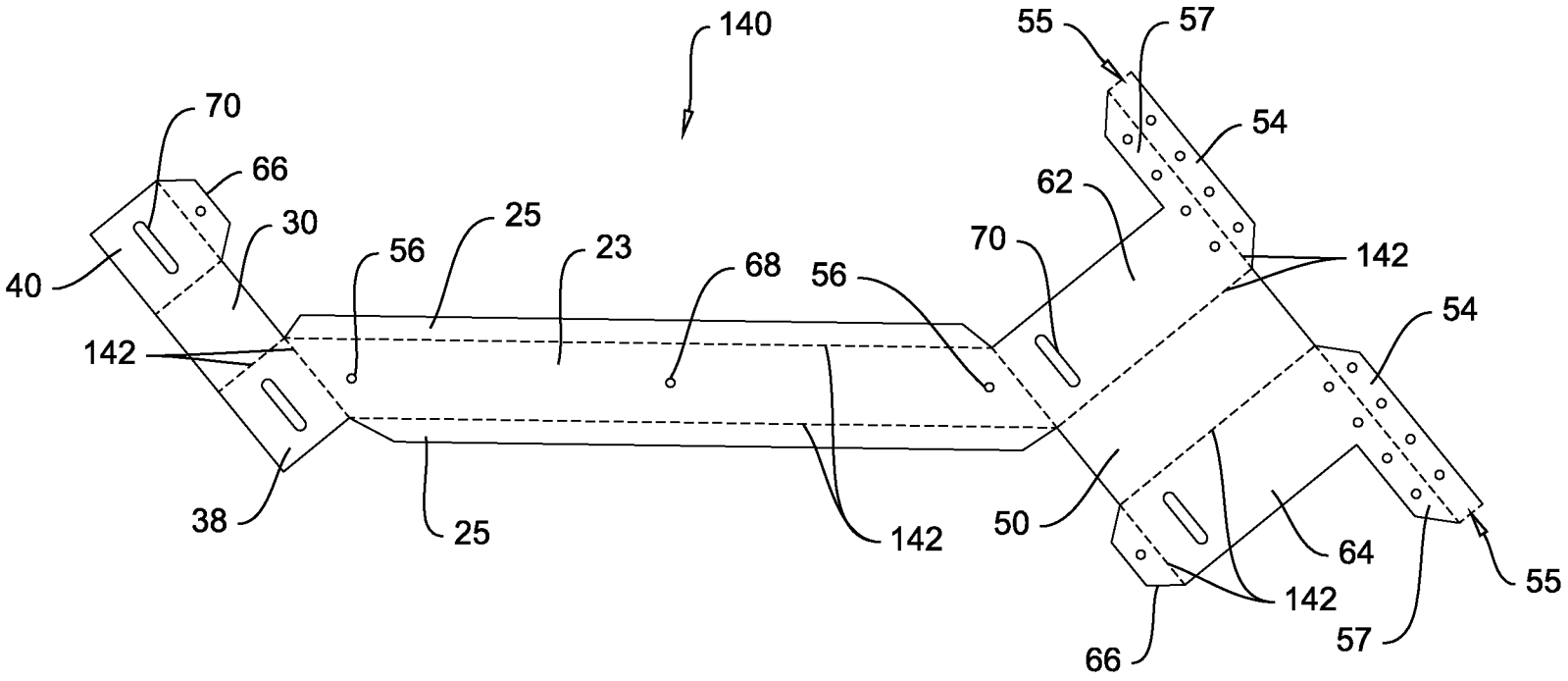
FIG. 13 is a top plan view of a cut sheet for forming the apparatus of FIG. 9.

Turning now to FIGS. 12 and 13, blanks for use in forming the beam engaging member 22 are illustrated. In particular FIG. 12 illustrates a blank 140 for forming the beam engaging member 22 of FIG. 2 while FIG. 13 illustrates a blank for forming the beam engaging member 22 of FIG. 9. In each of these In each case, the blank may cut to the illustrated shape and then be bent along bend lines 142 of the blank wherein the solid lines indicate cut lines and dashed lines indicate cut lines to form the blank into the shape as illustrated in FIGS. 2 and 9.

While specific embodiments of the invention have been described and illustrated, such embodiments should be considered illustrative of the invention only and not as limiting the invention as construed in accordance with the accompanying claims.

What is claimed is:

1. An apparatus for supporting adjacent parallel spaced apart joists from front surface of a perpendicular beam, each of said joists extending between first and second ends and having top and bottom edges, the apparatus comprising:

an elongate member sized to extend between a first end proximate to a top edge of a first joist and a second end proximate to a bottom edge of an second adjacent joist;

a joist support platform extending from said second end of said elongate member adapted to receive a bottom edge of a first joist thereon;

a pair of bottom fastening strips sized to extend substantially upwards from said joist support platform along said beam over a top edge of said beam wherein said bottom fastening strips having a planar surface parallel to said front surface of said beam; and a joist cap extending from said first end of said elongate member adapted to overly a top edge of a second joist adjacent to said first joist.

2. The apparatus of claim 1 wherein said joist support platform includes side walls extending therefrom to contain said joist therebetween.

3. The apparatus of claim 1 wherein said bottom fastening strips are located adjacent to said joist.

4. The apparatus of claim 1 wherein said bottom fastening strips include a plurality of fastener bores.

5. The apparatus of claim 1 wherein said joist cap extends to said beam.

6. The apparatus of claim 5 further comprising at least one top beam engaging panel extending from said joist cap.

7. The apparatus of claim 6 wherein said at least one top beam engaging panel comprises an end portion of said joist cap.

8. The apparatus of claim 6 wherein said at least one top beam engaging panel extends over a top of said beam.

9. The apparatus of claim 6 wherein said at least one top beam engaging panel comprises a pair of top fastening strips extending substantially downwards from said joist cap.

10. The apparatus of claim 9 wherein said top fastening strips are located adjacent to said joist.

11. The apparatus of claim 9 wherein said top fastening strips include a plurality of fastener bores.

12. A system for supporting adjacent parallel spaced apart joists from a perpendicular beam, each of said joists extending between first and second ends and having top and bottom edges, the system comprising:

at least one beam engaging member, each beam engaging member comprising:

an elongate member sized to extend between a first end proximate to a top edge of a first joist and a second end proximate to a bottom edge of an second adjacent joist;

a joist support platform extending from said second end of said elongate member adapted to receive a bottom edge of a first joist thereon;

a pair of bottom fastening strips extending substantially upwards from said joist support platform along said beam; and a joist cap extending from said first end of said elongate member adapted to overly a top edge of a second joist adjacent to said first joist; and at least one cross brace member, each cross-brace engaging member comprising:

an elongate member sized to extend between a first end proximate to a top edge of said second joist and a second end proximate to a bottom edge of said adjacent first joist;

a joist support platform extending from said second end of said elongate member; and a joist cap extending from said first end of said elongate member.

13. The system of claim 12 wherein said joist support platform of said at least one cross brace member is engageable with said joist support platform of said beam engaging member.

14. The system of claim 12 wherein said joist cap of said at least one cross brace member is engageable with said joist cap of said beam engaging member.

* * * * *